United States Patent [19]

Pradelle

[11] Patent Number: 4,780,052

[45] Date of Patent: Oct. 25, 1988

[54] ROTARY BLOWER WITH GUIDE SLEEVE

[75] Inventor: Bernard Pradelle, Limoges, France

[73] Assignee: Compagnie General des Matieres Nucleaires, Velizy Villacoublay, France

[21] Appl. No.: 91,875

[22] Filed: Sep. 1, 1987

[30] Foreign Application Priority Data

Sep. 2, 1986 [FR] France ..... 86 12327

[51] Int. Cl.[4] ..... F04D 29/66

[52] U.S. Cl. ..... 415/119; 415/197; 415/210

[58] Field of Search ..... 415/119, 208, 210, 174, 415/215, 197

[56] References Cited

U.S. PATENT DOCUMENTS

| | | | |
|---|---|---|---|
| 2,308,685 | 1/1943 | Hagen | 415/210 |
| 2,879,936 | 3/1959 | Faught | 415/197 X |
| 3,089,637 | 5/1963 | Bell | 415/210 X |
| 3,547,455 | 12/1970 | Daunt | 415/197 X |
| 3,976,393 | 8/1976 | Larson | 415/210 |
| 4,475,867 | 10/1984 | Smith | 415/119 |
| 4,508,486 | 4/1985 | Tinker | 415/119 |

FOREIGN PATENT DOCUMENTS

| | | | |
|---|---|---|---|
| 2009070 | 6/1979 | United Kingdom | 415/197 |

*Primary Examiner*—Robert E. Garrett
*Assistant Examiner*—Joseph M. Pitko
*Attorney, Agent, or Firm*—Larson & Taylor

[57] ABSTRACT

A blower has a tubular air flow guiding sleeve. An electric motor is located coaxially within the sleeve in a casing connected to the sleeve by flow-straightening blades and a propeller is fixed to a rotary shaft of the motor and placed in front of the blades. A central unit comprises the tubular casing constituting a single casting with the blades and a part of said sleeve surrounding the propeller. A length of that part around the propeller is machined concentrically to an inner surface of said casing slidably receiving the stator of the motor. A PTFE ring may be located in a recess of the sleeve in radial alignment with the propeller blade tips.

10 Claims, 2 Drawing Sheets

ROTARY BLOWER WITH GUIDE SLEEVE

BACKGROUND OF THE INVENTION

1. Technical Field

The invention relates to blowers of the type comprising a tubular sleeve for guiding the air flow provided with flow-straightening blades carrying a central unit including an electric motor whose shaft carries a propeller located in front of the blades.

2. Prior art

Blowers of the above type are already known. To reduce the costs of such a blower, the manufacturing techniques as economical as possible are used. In particular, for the high through-put industrial blowers, such as those used in mines, the sleeve, the straightening blades and the propeller are produced by casting. However these economical manufacturing techniques have a drawback. The parts produced have a wide size variation. Consequently, considerable clearances must be provided between movable parts. The large clearances and the centering defects cause turbulences which reduce the efficiency and which in addition notably increase the noise.

Compressors and blowers designed for uses for which the obtaining of a high efficiency is of prime importance are also known. In such rotary machines, high efficiency is obtained at a price of a cost not corresponding at all with that of an industrial blower, by machining the major part of the surfaces defining the flow.

SUMMARY OF THE INVENTION

It is an object of the invention to provide a blower whose cost is hardly greater than that of conventional industrial blowers, having a higher overall efficiency (ratio of the useful power to the power of the electric motor) and a reduced sound level.

To this end, there is provided a blower of the above-defined type wherein said central unit comprises a tubular casing constituting a single casting with the blades and a part of said sleeve surrounding the propeller and wherein a length of said part around the propeller is machined concentrically to an inner surface of said casing, the stator of said motor being slidably received within the casing.

Due to that arrangement, the propeller may be accurately centered within the machined part of the sleeve. Since the stator of the motor has a good contact with the casing, the heat generated in the electric motor is evacuated through the casing and the blades which consequently fulfil a dual function. A heat conducting grease, which may contain copper, is preferably located between the machined ferromagnetic body of the stator and the casing for enhancing thermal flow. The tubular casing, the blades and that part of the sleeve which surrounds the propeller preferably constitute a one part casting in a material having a high thermal conductivity. A suitable material is spheroidal graphite cast iron which has been subjected to a thermal treatment which increases its extension before rupture and makes it possible to accept temperature variations. The cast iron available under reference GS 400-12 is particularly suitable.

According to another aspect of the invention the sleeve is constituted by an outer jacket and an inner jacket fastened to one another, separated by sound-absorbing material. The inner jacket may bear a machined cylindrical segment or ring fastened thereto and radially aligned with the blades of the propeller. Due to the use of a fastened segment of short length, whose machining may be carried out at the same time as that of the support surfaces of the shaft bearings of the electric motor, it is possible to achieve accurate centering of the propeller and to reduce the radial clearance to a value of the order of a tenth of a mm for which the turbulences at the blade ends are quite small.

The segment can be housed in a cylindrical recess defined by two constituent parts of the inner jacket of such depth that the machined inner surface is substantially level with the inner surface of the two parts and does not cause a discontinuity which would generate be turbulence. The segment may be of polytetrafluorethylene which is subsequently machined.

Since it is possible to produce the jackets, the straightening blades and the propeller by casting and welding, construction may be at low cost. The presence of sound insulating material reduces the outer noise level on which the reduction in turbulance also has a favorable effect. Streamlining of the electric motor may be completed with an intake cone and a delivery cone reducing the head loss and further improving the overall efficiency. The inner jacket can further comprise a convergent lead-in duct.

The invention will be better understood from the following description of particular embodiments, given by way of examples. The description refers to the accompanying drawings.

SHORT DESCRIPTION OF THE DRAWINGS

DETAILED DESCRIPTION OF THE INVENTION

Figure 1:
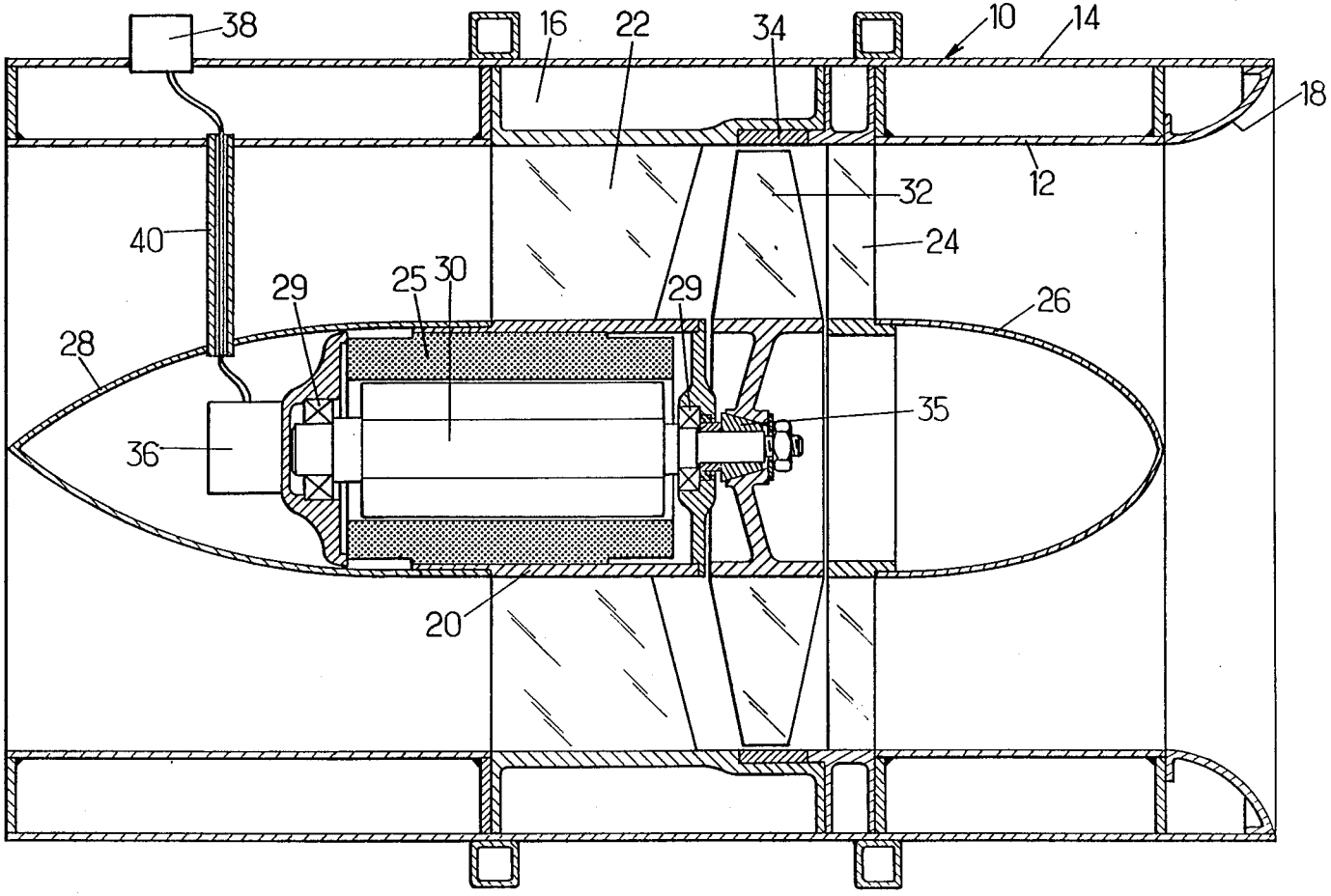
FIG. 1 shows a blower according to the invention, in section along a plane passing through its axis.

Referring to FIG. 1, the blower may be regarded as having a tubular sleeve assembly 10 for guiding the air flow and a central unit supported by the sleeve assembly.

As shown in FIG. 1, the sleeve assembly 10 comprises three successive parts. Each of the parts has an inner wall and an outer wall. The inner walls constitute an inner jacket 12 defining an air flow path. The outer walls constitute an outer jacket 14 concentric with the inner jacket and at a constant radial distance therefrom. A sound insulating material 16, such as rock wool, occupies the space between the jackets 12 and 14.

The front part of the sleeve assembly has a convergent duct 18 which guides the air streams for decreasing the head loss. The duct may be of stamped metal and welded to the inner jacket.

The central unit is carried by the central part of the inner jacket. The unit comprises a casing 20 supported and centered in the jacket by the flow straightening blades 22 and by a set of web elements 24. The blades and the webs are distributed regularly in the circumferential sense; the casing, blades and central part of the inner wall preferably constitute a single molded part or casting.

The stator 25 of an electric motor constituting the prime mover of the blower has a sliding fit in the casing and is secured thereto. A forward extension of the casing 20 consists of a bullet-shaped intake cone 26 and a backward extension consists of a tip 28 streamlined to reduce the head loss. The cone and the tip may be of stamped metal and fixed to the central part of the casing 20. Stator 25 is received in the casing 20 which constitutes part of a structure receiving bearings 29 in which the shaft 30 of the motor rotates. The shaft carries a propeller 32, placed between the webs 24 and the flow-straightening blades 22 in the axial direction.

The profile, setting and arrangement of the propeller blades 32 and of the straightening blades 22 are selected to optimize the efficiency for the set flow rate.

A segment 34 of moulded synthetic material is received in the inner jacket 12, radially aligned with the blades 32 for making it possible to adopt a very small clearance between the ends of the propeller blades 32 and the jacket 12. It is possible particularly to use a segment 34 of moulded or extruded polytetrafluorethylene. To ensure concentricity of the inner surface of the segment 34 and of the propeller 32, the segment 34 is machined at the same time as the surfaces receiving the bearings 29 supporting the shaft 30, that is to say with a same reference axis. Under these conditions, the alignment of the axis of the propeller and of the segment is sufficiently accurate to tolerate a radial clearance of about 0.1 mm between propeller 32 and segment 34.

The combination of features which have been described decreases the head loss, increases the efficiency and reduces the air-generated noises. The eddies at the end of the blades of the propeller 32 are reduced due to the low value of the clearance. The air flow around the motor occurs without turbulence, due to the continuousity nature of the boundary along the intake cone 26, the hub of the propeller whose diameter is equal to that of the central part of the casing 20 and the rear cone 28.

By way of example, a blower provided to receive a motor of 5 to 25 kW has a casing 20 up to 240 mm diameter, borne by seventeen straightening blades 22. The stator of the motor was slidably mounted in the central part of the casing 20 with friction, which ensures cooling. The propeller 32, balanced statically and dynamically, is mounted on a shaft 30 through a split cone 35 which guarantees coaxially of the shaft and propeller.

As shown in FIG. 1, the blower has accessory elements required for operation. The frame of the motor has a rear electrical connecting box 36 connected to a connection box 38, borne by the sleeve 10, by leads contained in a streamlined tube 40. The blower can also comprise elements (not shown) for measurement or monitoring, for example a pressure sensor situated at the intake of the blower, a motor temperature sensor, etc. The sleeve may be provided with fasteners for receiving a front air filter.

Figure 2:
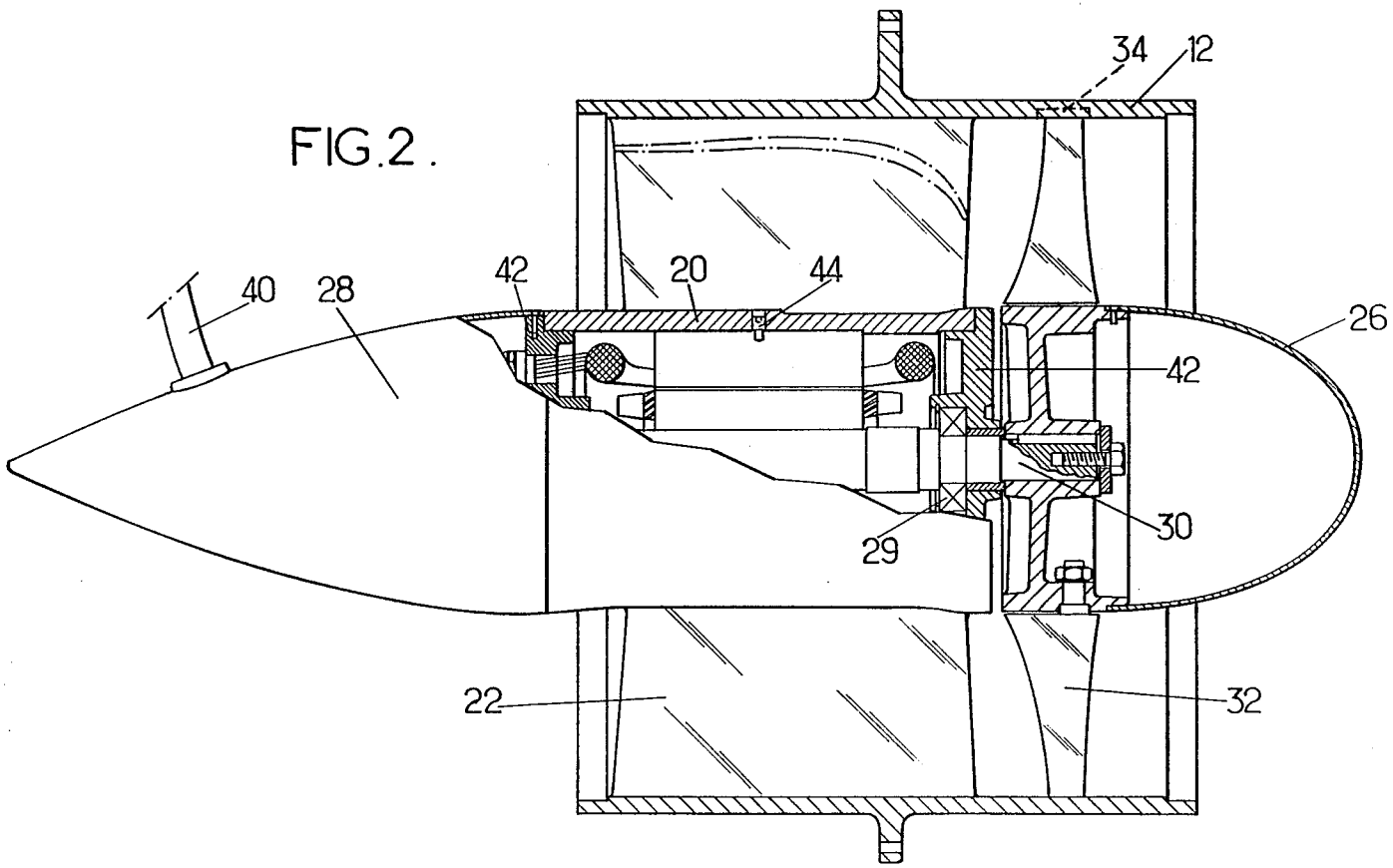
FIG. 2 is a representation of the central unit and of the part of the inner jacket which is integral with the casing of a blower according to a modified embodiment.

Referring to FIG. 2, wherein the elements corresponding to those of FIG. 1 are designated by the same reference numerals, a blower comprises a casting, typically of spheroidal graphite cast iron, incorporating casing 20, blades 22 and an axially mid part of the inner jacket 12. For improving cooling, the flow-straightening blades 22 extend over a length which exceeds that of the stator 25 of the motor. The blades have a shape (indicated in dash-dot lines) adapted to that of the blades of the propeller 32. The radially inner surface of casing 20 is machined concentrically to the part of the inner jacket which surrounds the propeller 32. Due to that machining, the side disks 42 which carry the bearings 29 and the stator 25 may be accurately centered within the part of the jacket radially aligned with the propeller blades. The outer surface of the ferromagnetic circuit of the stator is machined for being slidably received in the internal bore of casing 20 and it is secured against rotation by radial key means 44. A heat conducting lubricant is preferably located between the casing and the ferromagnetic circuit of the motor for improving heat transfer.

As illustrated in FIG. 2, the intake cone 26 is fixed to the propeller for rotating therewith. It is also possible to locate an annular segment or ring 34 of polytetrafluorethylene in an annular recess (indicated in dashes) of the mid portion of the inner jacket. That ring may be a portion of a large diameter polytetrafluorethylene tube. The ring is internally machined concentrically to the inner surface of the casing 20 after is has been secured in place.

It will be appreciated that the electric motor may be removed without difficulty, since it is sufficient to remove the key 44 and the rear side plate 42.

Modifications of the illustrated embodiments or combinations of features described in the embodiments, as well as other variations, are possible and it should be understood that the scope of the patent is defined only by the following claims:

I claim:

1. Blower comprising: a tubular air flow guiding sleeve having two mutually coaxial jackets separated with an annular layer of sound insulating material; a central unit having an electric motor, located coaxially within the sleeve and connected thereto by flow-straightening blades; and a propeller fixed to a rotary shaft of the motor and placed in front of the blades; wherein said central unit comprises a tubular casing constituting a one-part casting with the blades and with part only of said sleeve surrounding the propeller and wherein said part of said sleeve has a portion which surrounds the propeller and which is machined concentrically to an inner surface of said casing, said motor having a stator slidably received within the casing and in thermal contact therewith.

2. Blower according to claim 1, wherein said part carries an annular ring of a material different from that of said part, having an axial length at least equal to the length of blade tips of said propeller and internally machined coaxially to bearings carried by said tubular casting and supporting said rotary shaft.

3. Blower according to claim 2, wherein said ring is of polytetrafluorethylene.

4. Blower according to claim 1, wherein said flow straightening blades axially extend over the whole length of said stator at least.

5. Blower according to claim 1, wherein said central unit further comprises an intake cone and an exit cone.

6. Blower according to claim 1, wherein the central unit further comprises an intake cone carried by a plurality of webs distributed regularly in the circumferential sense and fixed to the sleeve in front of the propeller.

7. Blower according to claim 1, wherein the outer jacket consists of a plurality of mutually welded parts.

8. Blower according to claim 1, wherein said one-part casting consists of spheroidal graphite cast iron, wherein said stator has a machined ferromagnetic body in contact with said tubular casing and wherein heat-conducting grease is located between said stator and said tubular casing for enhancing thermal flow.

9. Blower comprising:

a tubular air flow guiding sleeve consisting of a plurality of coaxial sections located in mutual alignment along a common axis, each having a radially outer jacket and a radially inner jacket which are mutually coaxial and are separated by sound-insulating material;

a tubular casing located within the sleeve coaxially thereto and consisting a one-part casting with the radially inner jacket of a mid one of said plurality of coaxial sections and with flow straightening blades connecting said tubular casing and said radially inner jacket of said mid section;

an electric motor having a stator slidably received within the tubular casing, in thermal contact therewith and non-rotatably connected to said casing and a rotor coaxial to said tubular casing; and a propeller fixed to a rotary shaft belonging to said rotor and placed in front of said flow straightening blades within said radially inner jacket of said mid section;

wherein said sleeve is formed with a circumferential recess surrounding tips of blades of said propeller and accomodating an annular ring of polytetrafluorethylene material which is machined concentrically to said common axis and is separated from said tips by a radial clearance having an order of magnitude of one tenth of a millimeter.

10. Blower according to claim 9, wherein said recess is defined by the inner jackets of two axially adjacent ones of said sections and said annular ring is machined concentrically to said inner surface of said tubular casing.

* * * * *